US009770749B2

(12) United States Patent
Wu et al.

(10) Patent No.: US 9,770,749 B2
(45) Date of Patent: Sep. 26, 2017

(54) HYBRID STAMPING SYSTEM

(71) Applicant: GM GLOBAL TECHNOLOGY OPERATIONS LLC, Detroit, MI (US)

(72) Inventors: Dai-Yun Wu, Shelby Township, MI (US); Jorge F. Arinez, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 339 days.

(21) Appl. No.: 14/454,981

(22) Filed: Aug. 8, 2014

(65) Prior Publication Data

US 2016/0038989 A1 Feb. 11, 2016

(51) Int. Cl.

| | |
|---|---|
| ***B21D 22/02*** | (2006.01) |
| ***B21D 35/00*** | (2006.01) |
| ***B21D 37/01*** | (2006.01) |
| ***B21D 37/02*** | (2006.01) |
| ***B21D 37/20*** | (2006.01) |

(52) U.S. Cl.

CPC ..... *B21D 22/02* (2013.01); *B21D 35/007* (2013.01); *B21D 37/01* (2013.01); *B21D 37/02* (2013.01); *B21D 37/20* (2013.01); *B21D 37/205* (2013.01)

(58) Field of Classification Search

CPC ..... B21D 37/02; B21D 37/20; B21D 37/205

See application file for complete search history.

(56) References Cited

U.S. PATENT DOCUMENTS

| | | | | | |
|---|---|---|---|---|---|
| 1,571,673 | A * | 2/1926 | Jayne | B21D 53/268 | 72/328 |
| 2,291,722 | A * | 8/1942 | Ingersoll | B21J 1/06 | 172/604 |
| 2,625,196 | A * | 1/1953 | Cooper | B21D 25/04 | 24/522 |
| 2,670,779 | A * | 3/1954 | Mowrey | B21D 11/18 | 72/300 |
| 2,771,851 | A * | 11/1956 | Mcgregor | B21D 22/10 | 72/397 |
| 3,319,501 | A * | 5/1967 | Risher | B21D 37/205 | 76/107.1 |
| 4,576,030 | A * | 3/1986 | Roper | B21D 22/02 | 72/293 |

(Continued)

FOREIGN PATENT DOCUMENTS

| | | | |
|---|---|---|---|
| CN | 201543724 U | * | 8/2010 |
| DE | 102007054723 A1 | | 5/2009 |

*Primary Examiner* — Teresa M Ekiert
*Assistant Examiner* — Gregory Swiatocha
(74) *Attorney, Agent, or Firm* — Quinn IP Law

(57) ABSTRACT

A hybrid stamping system for forming a work-piece includes a stamping press. The press includes first and second dies that have respective first and second die bases formed from a first material. The system also includes first and second inlays. Each inlay is formed from a second material and has opposing die and work-piece sides. The second material hardness is greater than the first material hardness. The die side of the first inlay is cast into the first base and the work-piece side of the first inlay is contoured to form one side of the work-piece. The die side of the second inlay is cast into the second base and the work-piece side of the second inlay is contoured to form another side of the work-piece. The first and second dies are mounted in the press opposite one another to form the work-piece between the first and second inlays.

16 Claims, 4 Drawing Sheets

(56) References Cited

U.S. PATENT DOCUMENTS

| | | | | | |
|---|---|---|---|---|---|
| 4,984,487 | A * | 1/1991 | Beckmeyer | B23P 15/243 | 29/464 |
| 5,157,969 | A * | 10/1992 | Roper | B21D 22/10 | 29/421.1 |
| 6,006,564 | A * | 12/1999 | Frisby | B21J 3/00 | 72/354.6 |
| 2013/0255346 | A1 * | 10/2013 | Danby | B29C 67/0062 | 72/352 |

* cited by examiner

HYBRID STAMPING SYSTEM

TECHNICAL FIELD

The present disclosure generally relates to a hybrid stamping system for low-volume production of parts.

BACKGROUND

Stamping is a manufacturing process that includes such forming operations as punching, blanking, embossing, bending, flanging, and coining. The process of stamping typically employs a machine press to shape or cut a work-piece by deforming it with a die. The stamping process could be a single stage operation where every stroke of the press produces the desired form on the work-piece, or could occur through a series of stages. Although the stamping process is usually carried out on sheet-metal, it can also be used to form components from other materials, such as polystyrene.

SUMMARY

A hybrid stamping system for forming a work-piece includes a stamping press. The stamping system also includes a first die having a first die base formed from die base material, also referred to herein as a first material, and configured to be mounted in the stamping press, and a second die having a second die base formed from the die base material and configured to be mounted in the stamping press opposite the first die. The stamping system also includes a first inlay formed from an inlay material. The first inlay has a die side and a work-piece side. The die side of the first inlay is fixed by being cast-in and incorporated into the first die, while the work-piece side of the first inlay is contoured to form one side of the work-piece.

The stamping system also includes a second inlay formed from the inlay material, also referred to herein as a second material. The second inlay has a die side and a work-piece side. The die side of the second inlay is fixed by being cast-in and incorporated into the second die, while the work-piece side of the second inlay is contoured to form another side of the work-piece. The die base material is characterized by a first hardness and the inlay material is characterized by a second hardness that is greater than first hardness. The first and second dies are mounted in the stamping press, such that, when the stamping press is operated, the work-piece is formed between the work-piece side of the first inlay and the work-piece side of the second inlay.

The first inlay may include a first and a second segment and the second inlay may similarly include a first and a second segment. In such a case, the first segment of the first inlay abuts the second segment of the first inlay and the first segment of the second inlay abuts the second segment of the second inlay.

Each of the first and second segments of the first and second inlays may include a footing configured to support and provide a foundation for the specific segment in the respective first or second die base.

The first segment of the first inlay may be linked with the second segment of the first inlay via a first interlock and the first segment of the second inlay may be linked with the second segment of the second inlay via a second interlock.

Each of the first interlock and the second interlock may include a dovetail connection. Additionally, each of the first interlock and the second interlock may include an epoxy adhesive bond configured to generate a continuous transition between the first and second segments of the respective first and second inlays.

The die base material may be a Kirksite alloy, while the inlay material may be tool-grade steel.

At least one of the first and second segments of at least one of the first and second inlays may be formed via a three-dimensional (3D) printing process.

At least one of the first and second segments of at least one of the first and second inlays may be formed via at least one of a casting process and a machining process.

The hybrid stamping system may additionally include a binder element having a binder base formed from the die base material. In such a case, the binder element may be mounted in the stamping press and configured to be displaced relative to the first die for ejecting the work-piece therefrom. Additionally, the binder element may include a binder inlay formed from the inlay material, such that the binder inlay has a die side and a work-piece side. The die side of the binder inlay may then be cast-in and incorporated into the binder base.

A method of manufacturing a hybrid stamping system for forming a work-piece is also disclosed. The method includes positioning the first inlay in a first casting mold. The method also includes casting the first die base from the die base material in the first casting mold to thereby fix the die side of the first inlay to the first die base and form the first die. The method also includes positioning the second inlay in a second casting mold. The method additionally includes casting the second die base from the die material in the second casting mold to thereby fix the die side of the second inlay to the second die base and form the second die. Furthermore, the method includes mounting the first die and the second die opposite one another in a stamping press.

The above features and advantages, and other features and advantages of the present disclosure, will be readily apparent from the following detailed description of the embodiment(s) and best mode(s) for carrying out the described disclosure when taken in connection with the accompanying drawings and appended claims.

DETAILED DESCRIPTION

Those having ordinary skill in the art will recognize that terms such as "above", "below", "upper", "lower", "top", "bottom", etc., are used descriptively for the figures, and do not represent limitations on the scope of the disclosure, as defined by the appended claims.

Figure 1:
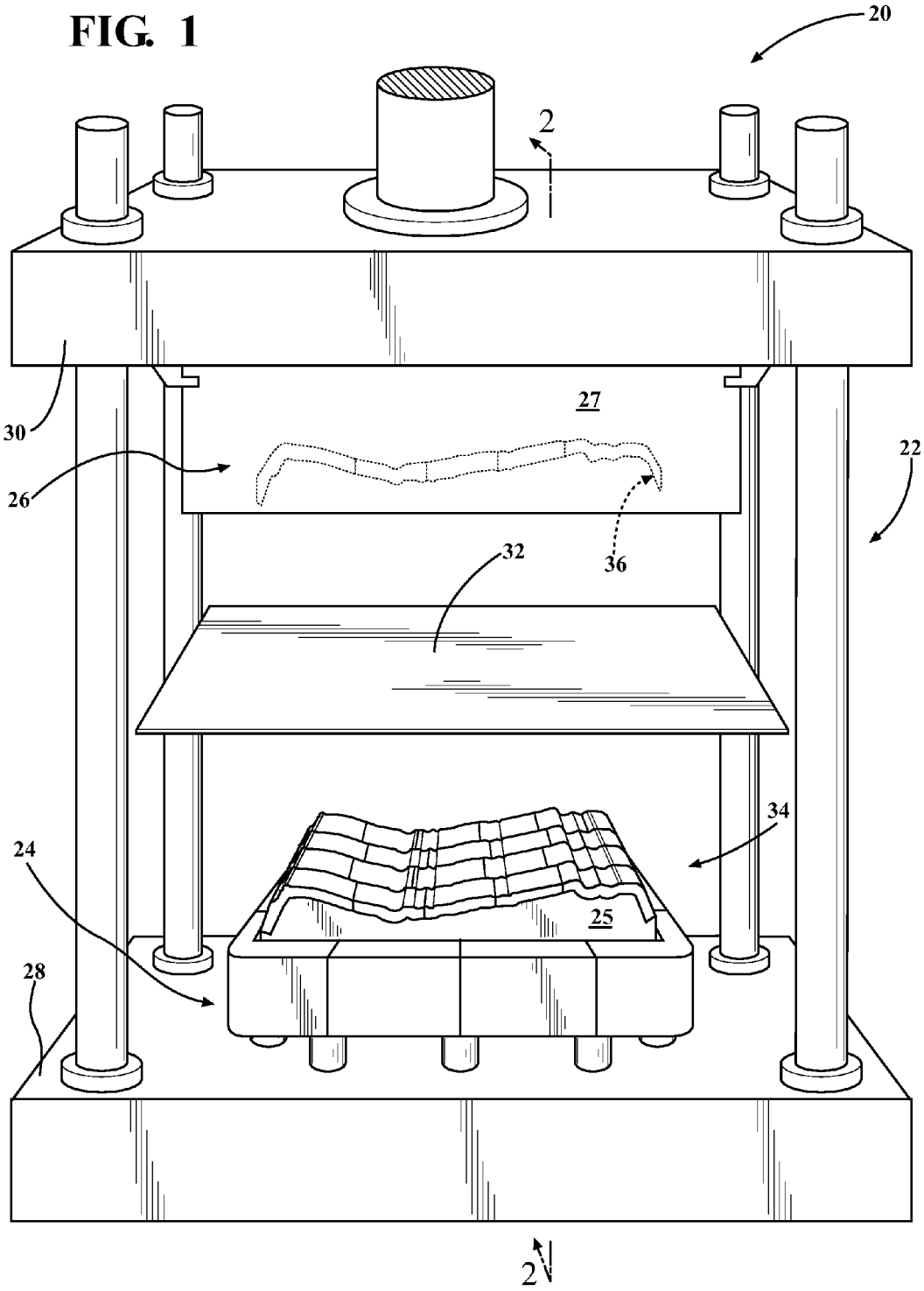
FIG. 1 is a schematic perspective view of a stamping press employing a hybrid stamping system that includes upper die, lower die, and binder, each having inlays, and a work-piece positioned between the inlays.

Referring to the Figures, wherein like numerals indicate like parts throughout the several views, a hybrid stamping system is generally shown at 20 in FIG. 1. The hybrid stamping system 20 may be configured for forming a component 10 (shown in FIG. 2), such as but not limited to a body panel, a support bracket, a heat shield, or some other article that can be manufactured by a stamping process from a work-piece or sheet-metal blank 32, as shown in FIG. 1. As primarily envisioned, the hybrid stamping system 20 may employed for "low volume" production of components 10 from any formable base metal, such as steel, aluminum, magnesium, or titanium, without losing definition of the desired contour for the manufactured components, but may similarly be used to form components from other materials, such as polystyrene. Such "low volume" production runs may, at times, generate thousands of subject components.

The hybrid stamping system 20 includes a stamping press 22. As known, a stamping press is generally a machine tool that is used to shape and/or cut material, commonly metal, by using specifically configured dies. Accordingly, as shown, the stamping press 22 includes a first or lower forming die 24 and a second or upper forming die 26. The upper die 26 is configured for mounting in the stamping press 22 opposite the lower die 24. Additionally, a typical stamping press includes a bolster plate, depicted as element 28, and a ram, depicted as element 30. The bolster plate 28 is typically configured as a large stationary metal block upon which the lower die 24 is clamped. Large stamping presses, like the ones used in the automotive industry, may have a die cushion (not shown) integrated in the bolster plate 28 to apply holding forces to a work-piece or sheet-metal blank 32. Such a die cushion may be necessary when a single acting press, in which a single ram is used to both hold the work-piece against the lower die and form the work-piece, is used for deep drawing. Similar to the bolster plate 28, the ram 30 is typically configured as a solid metal block that is clamped to the upper die 26 and provides the stroke, i.e., up and down movement, in the stamping press 22. The up and down action of the upper die 26 causes the stamping press 22 to produce parts having a desired contour or shape from the work-piece 32 fed therethrough. The stamping press 22 may be part of an initial or an intermediate stage in a multi-stage stamping operation that is designed to form a desired final shape from the work-piece 32.

Of particular note, the lower and upper dies 24, 26 described herein may also be configured as drawing, trim, flange, pierce or extrude dies, wherein the application of such specifically employed dies is understood by those skilled in the art. Therefore, although in the present disclosure the lower and upper dies 24, 26 are primarily described as being designed and arranged to perform the function of forming dies, nothing precludes the construction of the lower and upper dies 24, 26 as described in detail below from being applied to the above mentioned drawing, trim, flange, pierce or extrude dies.

As shown in FIG. 1, the lower die 24 includes a first or lower die base 25. The lower die base 25 is formed by a casting process from a die base or first material M1, such as a Kirksite alloy. The first material M1 is characterized by a first hardness H1, and is configured to be mounted in the stamping press 22. The hardness H1 may be in the range of BN 98-100 on the Brinell scale (HB). Additionally, impact strength of the first material M1 may be in the range of 40-50 Joules per cube meter ($J \cdot m^{-3}$). In general, Kirksite material has zinc as a base metal and includes alloying elements of aluminum, magnesium, and copper. Dies cast from Kirksite provide low-cost tooling because the alloy can be accurately cast, requiring a minimum of finishing. In addition, Kirksite has been used as a general purpose casting alloy for non-stressed, i.e., typically non-structural, components. The upper die 26 includes a second or upper die base 27. The upper die base 27 is also formed from the same die material M1 as the lower die base 25. Kirksite is a moderate strength alloy capable of serving as a forming tool material for smaller production runs of component 10. However, Kirksite is relatively soft, as compared with, for example, steel, and thus tends to wear comparatively quickly. As a result, dies that have Kirksite forming surfaces cannot support large volume production. Generally, Kirksite can withstand part production runs in the hundreds, as compared with volume production tools that are often required to produce parts in the thousands. Accordingly, Kirksite is typically used for manufacturing prototype parts.

The hybrid stamping system 20 also includes a first inlay 34 and a second inlay 36. Both the first inlay 34 and the second inlay 36 are formed from an inlay or second material M2 that is characterized by a second hardness H2 that is greater than first hardness H1. The second material M2 for the first and second inlays 34, 36 may be tool-grade steel, such as FCD25, cast iron, cast steel or any other metal having similarly appropriate hardness. Generally, tool-grade steels are carbon and alloy steels that are particularly well-suited to be made into tools due to the subject materials' distinctive hardness, resistance to abrasion, ability to hold a cutting edge, and/or their resistance to deformation at elevated temperatures. Tool-grade steel is frequently used in a heat-treated state. Carbon content of tool-grade steels is typically in the range of 0.7-1.5%. On the Brinell scale (HB), the hardness H2 may be in the range of BN 143-248 for cast iron, HRB 85-HRC 26 for cast steel, and HRC 54-HRC 65 for tool steel. Additionally, representative impact strength of the first material M2 may be in the range of 204-585 MPa for minimum tensile strength of cast iron or 10.8-20.3 Joules on the Charpy Impact scale for various steels. Accordingly, the second material hardness H2 for the first and second inlays 34, 36 is selected for the above material properties, while the first material hardness H1 for the lower and upper die bases 25, 27 is selected for ease of formability and reduced cost. When the inlays 34, 36 are combined with the respective lower and upper die bases 25, 27, the resultant die system is capable of supporting production runs of components 10 at low volumes, with reduced tooling cost, and with replaceable wear parts—the inlays 34, 36.

The first inlay 34 is defined by a die side 34A and an opposing work-piece side 34B. The die side 34A is fixed in the lower die base 25 of the first inlay 34 and the work-piece side 34B of the first inlay is contoured to form one side of the work-piece 32 such that the finished component 10 has a desired shape on the side of the lower die 24. The first inlay 34 is formed prior to the forming of the lower die base 25, and is then incorporated or integrated into the lower die base during the casting of the lower die base. Accordingly, following the casting of the lower die base 25, the die side 34A becomes fixed in the lower die base of the first inlay 34 without the use of any separate fasteners, such as screws or clamps, and the work-piece side 34B is exposed to form a desired contour of the finished component 10 on the side of the lower die 24.

Similarly, the second inlay 36 is defined by a die side 36A and an opposing work-piece side 36B. The die side 36A is fixed in the upper die base 27 and the work-piece side 36B of the second inlay is contoured to form another, i.e., opposite, side of the work-piece 32 such that the finished component 10 has a desired shape on the side of the upper die 26. The second inlay 36 is formed prior to the forming of the upper die base 27, and is then incorporated or integrated into the upper die base during the casting thereof. Therefore, following the casting of the upper die base 27, the die side 36A becomes fixed in the upper die base of the second inlay 36 without the use of any separate fasteners, such as screws or clamps, and the work-piece side 36B is exposed to form a desired contour of the finished component 10 on the side of the upper die 26. Following the cast-in incorporation of the inlays 34, 36 into the respective lower and upper die bases 25, 27, the upper and lower dies 24, 26 are mounted in the stamping press 22. Accordingly, during operation of the stamping press 22, the work-piece 32 is formed between the work-piece side 34B of the first inlay 34 and the work-piece side 36B of the second inlay 36 to generate the desired shape of component 10.

Figure 2:
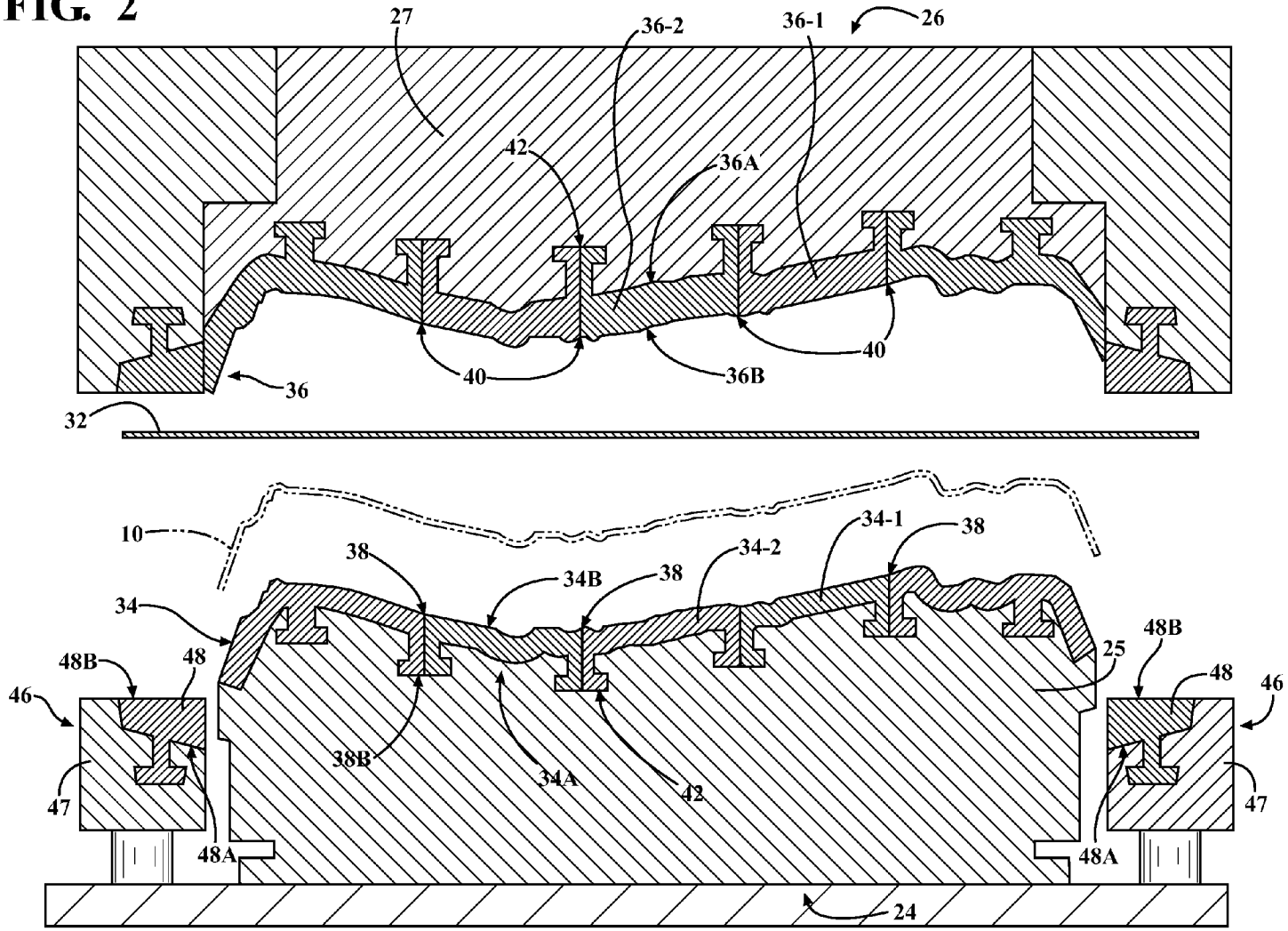
FIG. 2 is a schematic close-up cross-sectional side view of the upper die and lower die with binder, each having inlays, along section 2-2 shown in FIG. 1.
Figure 3:
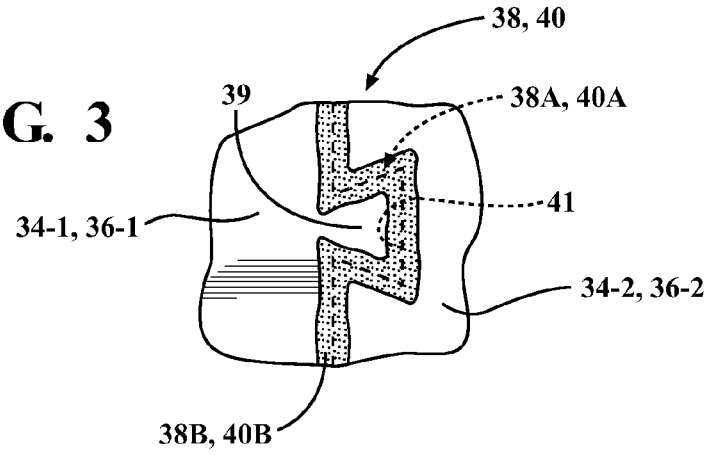
FIG. 3 is a schematic close-up top view of the inlays shown in FIGS. 1-2.
Figure 4:
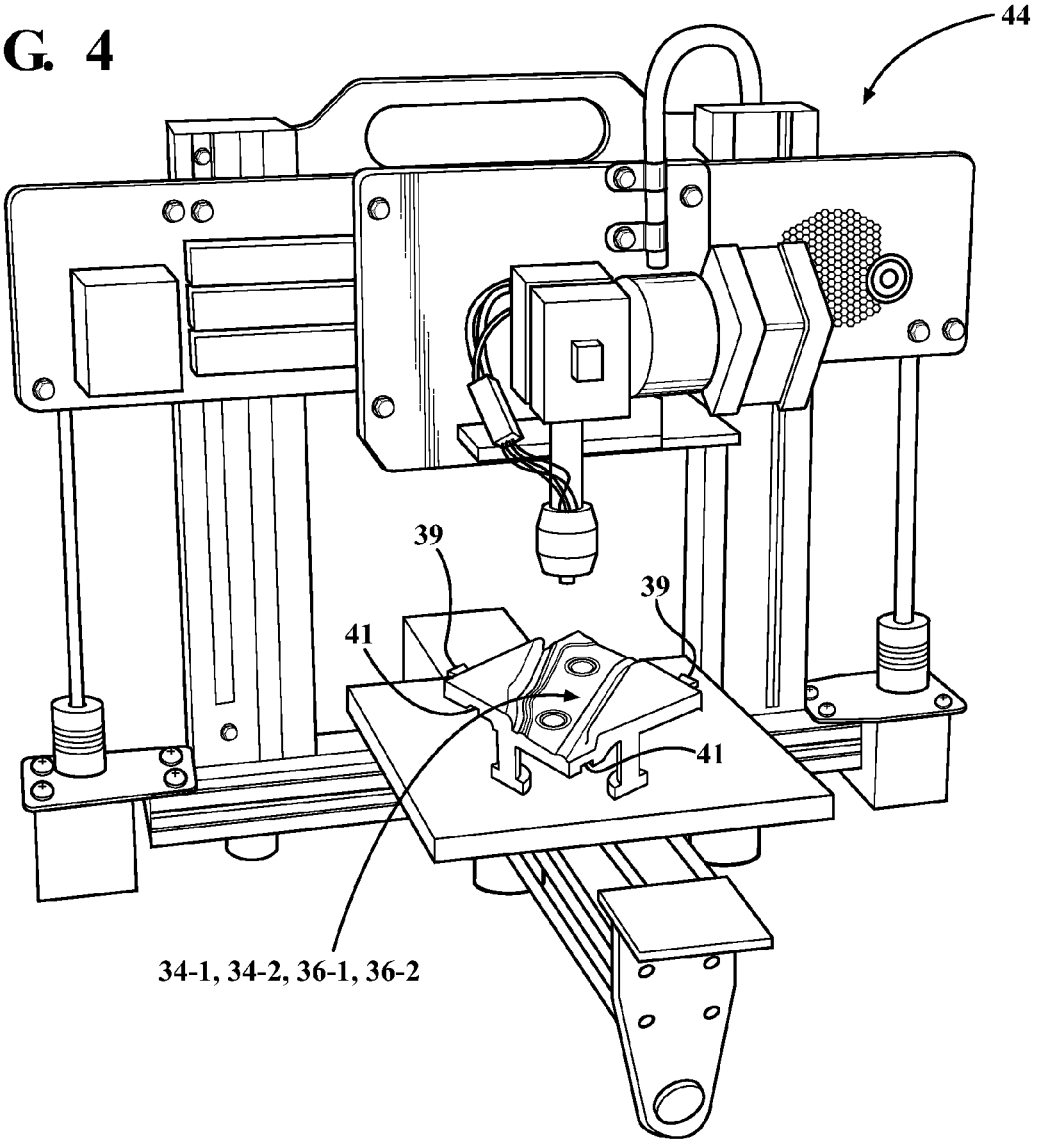
FIG. 4 is a schematic perspective view of a 3D printer being employed in manufacturing individual segments of the inlays shown in FIG. 3.

FIG. 2 depicts a cross-sectional side view of the upper and lower dies 24, 26 having the first and second inlay 34, 36. The cross-sectional side view of the upper and lower dies 24, 26 shown in FIG. 2 is taken along section 2-2 that is shown in FIG. 1, with components of the stamping press 22 removed for clarity. As shown, the first inlay 34 may include a plurality of interlocking segments, as illustrated by an exemplary first segment 34-1 and second segment 34-2. The first segment 34-1 of the first inlay 34 abuts the second segment 34-2 of the first inlay. The first segment 34-1 is linked with the second segment 34-2 via a first interlock 38. As shown in FIG. 3, the first interlock 38 may include a dovetail connection 38A. The first interlock 38 may also include an epoxy adhesive bond 38B configured to generate a smooth and continuous transition between the first and second segments 34-1, 34-2 and also seal the first interlock. Similarly, the second inlay 36 may include a respective plurality of interlocking segments, for example a first segment 36-1 and a second segment 36-2, as shown in FIG. 2. The first segment 36-1 of the second inlay 36 abuts the second segment 36-2 of the second inlay 36 and is linked therewith via a second interlock 40. Similar to the first interlock 38, the second interlock 40 may include a dovetail connection 40A, as shown in FIG. 3. As shown in FIGS. 3 and 4, each dovetail connection 38A and 40A includes a male portion 39 and a female portion 41.

As shown in FIG. 3, the second interlock 40 may additionally include an epoxy adhesive bond 40B that is similar to the adhesive bond 38B for generating a smooth and continuous transition between the first and second segments 36-1, 36-2 and also sealing the second interlock. Although a dovetail connection is shown in the respective interlocks 38 and 40, other types of connections may be used, such as a tongue and groove joint (not shown, but known to those skilled in the art), that facilitate a reliable interlocking joint with a resistance to being pulled apart. Additionally, as shown in FIG. 2, each of the first and second segments 34-1, 34-2, 36-1, and 36-2 of the respective first and second inlays 34, 36 may include a footing 42. The footing 42 is configured to support and provide a foundation for each segment 34-1, 34-2, 36-1, and 36-2 in the respective lower and upper die bases 25, 27.

Each of the first and second segments 34-1, 34-2 of the first inlay 34, as well as each of the first and second segments 36-1, 36-2 of the second inlay 36 may be formed via a three-dimensional (3D) printing process. In general, 3D printing is a type of manufacturing process used to generate a three-dimensional solid object from a digital model. 3D printing is achieved using an additive process, where successive layers of material are laid down in different shapes. As such, 3D printing is distinct from traditional machining techniques, which mostly rely on the removal of material by methods such as cutting or drilling, i.e., subtractive processes. Generally, a digital model employs 3D digital data, such as solid models, 3D product and manufacturing information and associated metadata, within 3D computer-aided design (CAD) software to provide specifications for individual components and product assemblies.

The type of information typically included in a digital model for 3D printing is geometric dimensions and tolerances (GD&T), component level materials, assembly level bill of materials, engineering configuration, design intent, etc. An example of a 3D printer 44 that may be employed in manufacturing of the first and second segments 34-1, 34-2, and the first and second segments 36-1, 36-2 is shown in FIG. 4. The 3D printer 44 is a specialized industrial robot that is capable of carrying out the material additive process under computer control. In the alternative, each of the first and second segments 34-1, 34-2 of the first inlay 34, as well as each of the first and second segments 36-1, 36-2 of the second inlay 36 may be formed via more traditional casting and/or machining processes.

As shown in FIGS. 1 and 2, the hybrid stamping system 20 may also include a binder element 46 having a binder base 47 formed from the die base material, i.e., same as the lower die base 25 and the upper die base 27. The binder element 46 is mounted in the stamping press 22 and configured to be displaced relative to the lower die 24 for ejecting the work-piece 32 therefrom following completion of the forming operation. The binder element 46 also includes a binder inlay 48 formed from the inlay material, i.e., same as the first and second inlays 34, 36. Similar to the lower die 24, the binder inlay 48 has a die side 48A and a work-piece side 48B, wherein the die side of the binder inlay is cast-in and incorporated into the binder base 47. Similar to the first and second inlays 34, 36, the binder inlay 48 may include a plurality of interlocking segments that are linked with each other via interlocks, such as the first and second interlocks 38, 40 and all their attendant features, as described in detail above and shown in FIG. 3. The individual segments of the binder inlay 48 may be formed via the three-dimensional (3D) printing process, as described above relative to the segments 34-1, 34-2, 36-1, and 36-2 with respect to FIG. 4.

Figure 6:
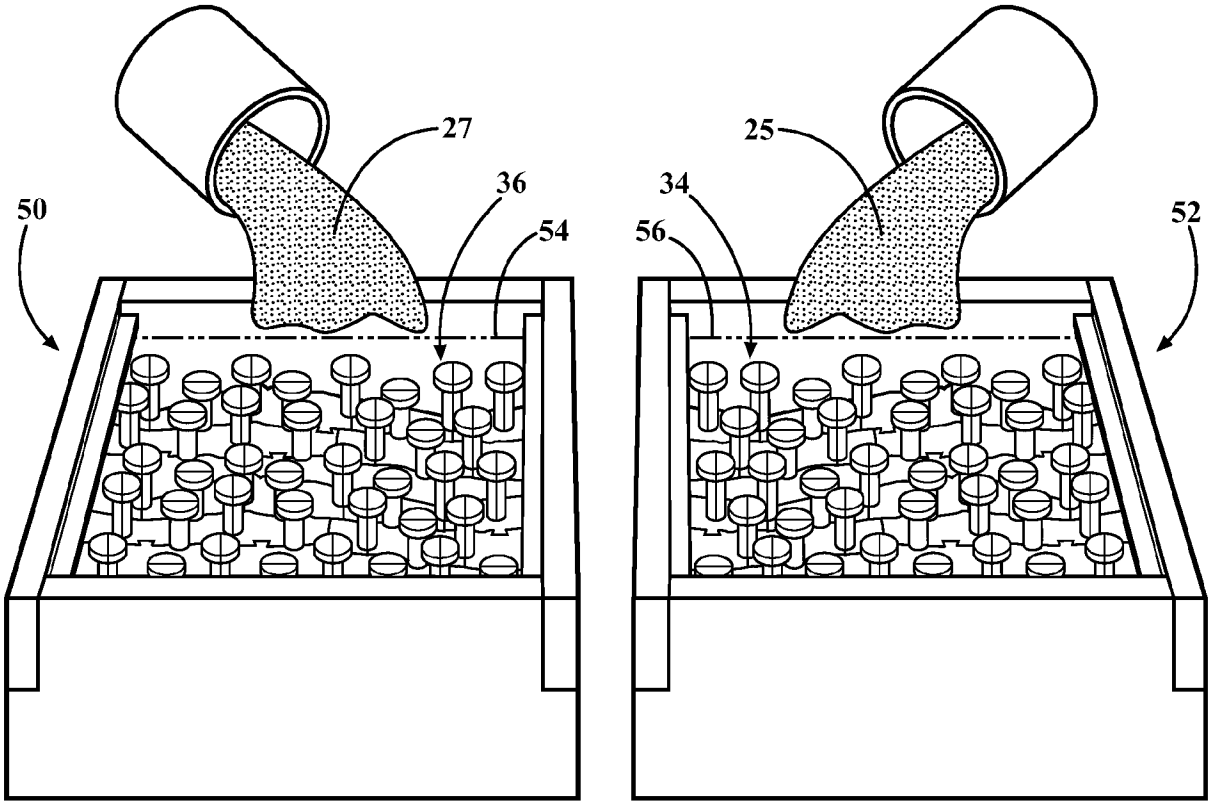
FIG. 6 is a schematic perspective view of tools used during manufacturing and assembly of the stamping system shown in FIGS. 1-3 according to the method shown in FIG. 4.
Figure 5:
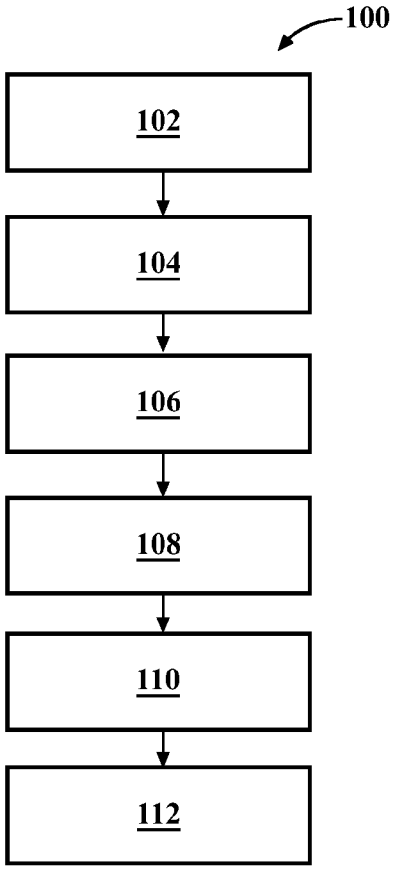
FIG. 5 is a flow diagram of a method of manufacturing the hybrid stamping system shown in FIGS. 1-3.

FIG. 5 depicts a method 100 of manufacturing the hybrid stamping system 20 shown in FIGS. 1-4 for forming the work-piece 32 and with reference to FIG. 6 showing additional tools used during manufacturing and assembly of the stamping system. Accordingly, the method 100 commences in frame 102 with providing the first and second inlays 34, 36. As discussed above with respect to FIGS. 1-3, providing the first inlay 34 may also include having the first segment 34-1 abut the second segment 34-2. Similarly, providing the second inlay 36 may include having the first segment 36-1 abut the second segment 36-2. Additionally, providing the first inlay 34 may include linking the first segment 34-1 with the second segment 34-2 via the first interlock 38. As discussed above, the first interlock 38 may include the dovetail connection 38A and an epoxy adhesive bond 38B. Similarly, providing the second inlay 36 may include linking the first segment 36-1 with the second segment 36-2 via the second interlock 40. The second interlock 40 may include the dovetail connection 40A and the epoxy adhesive bond 40B, as described in detail with respect to FIGS. 1-3.

As discussed above with respect to FIGS. 1-4, providing the first and second inlays 34, 36 may include forming at least one of the first segments 34-1, 34-2 and second segments 36-1, 36-2, of the respective first and second inlays in the 3D printer 44 via the 3D printing process. In the alternative, providing the first and second inlays 34, 36 may include forming at least one of the first segments 34-1, 34-2 and second segments 36-1, 36-2, of the respective first and second inlays via a casting process employing dedicated casting tools and/or a machining process.

Following frame 102 the method advances to frame 104, where the method includes positioning the lower inlay 34 in a first casting mold 50. After frame 104 the method proceeds to frame 106, where the method includes casting the lower die base 25 from the first material M1 in the first casting mold 50 to thereby fix the die side 34A of the first inlay 34 to the lower die base and thereby incorporating the first inlay into the lower die base. After frame 106 the method advances to frame 108, where the method includes positioning the second inlay 36 in a second casting mold 52. Following frame 108 the method advances to frame 110. In frame 110 the method includes casting the upper die base 27 from the first material M1 in the second casting mold 52 to thereby fix the die side 36A of the second inlay 36 to the second die base and thereby incorporating the second inlay into the lower die base. Accordingly, the above method steps generate the respective lower and upper dies 24, 26 by incorporating the inlays 34, 36 into the respective die bases 25, 27 via a casting process, as illustrated in FIG. 6. As discussed above with respect to FIGS. 1-3, fixing the die side 34A of the first inlay 34 in the lower die base 25 may include supporting the first and second segments 34-1, 34-2 of the first inlay in the lower die base via the footing 42. Similarly, fixing the die side 36A of the second inlay 36 in the upper die base 27 may include supporting the first and second segments 36-1, 36-2 of the second inlay in the upper die base via the footing 42.

Additionally, in frame 110 the method may include shaping individual casting patterns 54, 56 from a sacrificial material, such as Styrofoam. The casting patterns 54, 56 may be assembled with inlays 34, 36 first and then be positioned in the respective casting molds 50, 52 to accept the respective die side 34A of the first inlay 34 and the die side 36A of the second inlay 36. Following positioning of the casting patterns 54, 56 together with the first and second inlays 34, 36 in the respective casting molds 50, 52, the casting sand will be poured around the assembled inlays 34, 36 and patterns 54, 56. The casting sand will be compacted to form a hard shape around the assembled inlays 36, 36 and patterns 54, 56. The patterns 54, 56 will then be removed from the casting molds 50, 52 to provide the cavities for the first material M1 of lower and upper die bases 25, 27 to be poured into the respective casting molds (as shown in FIG. 6). As a result, the first inlay 34 will become incorporated or fixed in the lower die base 25 and the second inlay 36 will become incorporated or fixed in the upper die base 27. Furthermore, the binder inlay 48 may be fixed in the binder base 47 via the same process and in the first casting mold 50 alongside the lower die base 25, or in a separate mold, if so desired. Thus completed lower die 24, upper die 26, and binder element 46 may then be removed from the respective casting molds 50 and 52. Furthermore, the method 100 may include machining and/or polishing of the work-piece sides 34B, 36B of the respective first and second inlays 34, 36, as well as the work-piece side of the binder inlay 48B to achieve desired contour and surface finish of the manufactured component 10.

Following frame 110 the method proceeds to frame 112, where the method includes mounting the formed lower die 24 along with the binder element 46 opposite the upper die 26 in the stamping press 22. After the lower die 24, the upper die 26, and the binder element 46 have been mounted in the stamping press 22, the hybrid stamping system 20 maybe initially tried out to verify that the system is ready to be used for volume production, i.e., for forming the work-piece 32. The stamping press 22 may also be part of a multi-stage stamping operation that is designed to form a desired final shape from the work-piece 32. Accordingly, as part of the stamping process, after the forming of the work-piece 32 via the hybrid stamping system 20 shown in FIGS. 1-3, additional operations, such as restrike and piercing may also take place. Furthermore, the desired final shape of the component 10 may be generated by trimming the formed work-piece 32 via a separate trimming die or a laser operation, neither of which is shown, but known to those skilled in the art. Overall, the method 100 may be used to provide the hybrid stamping system 20 which is capable of supporting "low volume" production runs of components 10 at reduced tooling cost.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A hybrid stamping system for forming a work-piece, the system comprising:

a stamping press;

a first die having a first die base formed from a die base material and configured to be mounted in the stamping press;

a second die having a second die base formed from the die base material and configured to be mounted in the stamping press opposite the first die;

a first inlay formed from an inlay material, the first inlay having a die side and a work-piece side, wherein the die side of the first inlay is cast-in and incorporated into the first die base and the work-piece side of the first inlay is contoured to form one side of the work-piece; and a second inlay formed from the inlay material, the second inlay having a die side and a work-piece side, wherein the die side of the second inlay is cast-in and incorporated into the second die base and the work-piece side of the second inlay is contoured to form another side of the work-piece;

wherein:

the die base material is characterized by a first hardness and the inlay material is characterized by a second hardness that is greater than the first hardness;

the first and second dies are mounted in the stamping press, such that, when the stamping press is operated, the work-piece is formed between the work-piece side of the first inlay and the work-piece side of the second inlay;

the first inlay includes a first and a second segment and the second inlay includes a first and a second segment, wherein the first segment of the first inlay abuts the second segment of the first inlay, and wherein the first segment of the second inlay abuts the second segment of the second inlay; and the first segment of the first inlay is linked with the second segment of the first inlay via a first interlock and the first segment of the second inlay is linked with the second segment of the second inlay via a second interlock.

2. The hybrid stamping system as set forth in claim 1, wherein each of the first and second segments of the first and second inlays includes a footing configured to support each segment in the respective first and second die bases.

3. The hybrid stamping system as set forth in claim 1, wherein the first interlock and the second interlock each includes a dovetail connection.

4. The hybrid stamping system as set forth in claim 1, wherein the first interlock and the second interlock each includes an epoxy adhesive bond providing a continuous transition between the first and second segments of the respective first and second inlays.

5. The hybrid stamping system as set forth in claim 1, wherein the die base material is a Kirksite alloy and the inlay material is tool-grade steel.

6. The hybrid stamping system as set forth in claim 1, wherein at least one of the first and second segments of at least one of the first and second inlays is formed via a three-dimensional (3D) printing process.

7. The hybrid stamping system as set forth in claim 1, wherein at least one of the first and second segments of at least one of the first and second inlays is formed via at least one of a casting process and a machining process.

8. The hybrid stamping system as set forth in claim 1, further comprising a binder element having a binder base formed from the die base material, wherein:

the binder element is mounted in the stamping press and configured to be displaced relative to the first die for ejecting the work-piece therefrom;

the binder element includes a binder inlay formed from the inlay material; and the binder inlay has a die side and a work-piece side, and wherein the die side of the binder inlay is cast-in and incorporated into the binder base.

9. A method of manufacturing a hybrid stamping system for forming a work-piece, the method comprising:

providing a first inlay from an inlay material, the first inlay having a die side and a work-piece side, wherein the work-piece side of the first inlay is contoured to form one side of the work-piece, wherein the first inlay includes a first and a second segment, and wherein said providing the first inlay includes having the first segment of the first inlay abut the second segment of the first inlay and includes linking the first segment of the first inlay with the second segment of the first inlay via a first interlock;

positioning the first inlay in a first casting mold;

casting a first die base from a die base material in the first casting mold and thereby fixing the die side of the first inlay to the first die base to form a first die, wherein the die base material is characterized by a first hardness and the inlay material is characterized by a second hardness that is greater than the first hardness;

providing a second inlay from the inlay material, the second inlay having a die side and a work-piece side, wherein the work-piece side of the second inlay is contoured to form another side of the work-piece, wherein the second inlay includes a first and a second segment, and wherein said providing the second inlay includes having the first segment of the second inlay abut the second segment of the second inlay and includes linking the first segment of the second inlay with the second segment of the second inlay via a second interlock;

positioning the second inlay in a second casting mold;

casting a second die base from the die base material in the second casting mold and thereby fixing the die side of the second inlay to the second die base to form a second die; and mounting the first die, and mounting the second die opposite the first die in a stamping press.

10. The method as set forth in claim 9, wherein each of the first and second segments of the first and second inlays includes a footing, and wherein said fixing the die side of the first inlay to the first die base and said fixing the die side of the second inlay to the second die base includes supporting the first and second segments of the first and second inlays in the respective first and second die bases via the respective footing.

11. The method as set forth in claim 9, wherein the first interlock and the second interlock each includes a dovetail connection.

12. The method as set forth in claim 9, wherein the first interlock and the second interlock each includes an epoxy adhesive bond, the method further comprises providing a continuous transition between the first and second segments of the respective first and second inlays via the epoxy adhesive bond.

13. The method as set forth in claim 9, wherein the die base material is a Kirksite alloy and the inlay material is tool-grade steel.

14. The method as set forth in claim 9, wherein providing at least one of the first and second inlays includes forming at least one of the first and second segments of the respective inlay via a three-dimensional (3D) printing process.

15. The method as set forth in claim 9, wherein providing at least one of the first and second inlays includes forming at least one of the first and second segments of the respective inlay via at least one of a casting process and a machining process.

16. The method as set forth in claim 9, wherein:

said providing the first inlay includes providing a binder inlay;

said casting the first die base includes casting a binder base from the die base material in the first casting mold and thereby fixing the die side of the binder inlay to the binder base to form a binder element; and said mounting the first die includes mounting the binder element in the stamping press such that the binder element is arranged to be displaced relative to the first die for ejecting the work-piece therefrom.

* * * * *